US008628204B2

(12) United States Patent
Reinhard-Herrscher et al.

(10) Patent No.: US 8,628,204 B2
(45) Date of Patent: Jan. 14, 2014

(54) COOKING OVEN WITH AN ILLUMINATION-EQUIPMENT AND AN ILLUMINATION-EQUIPMENT FOR A CAVITY OF A COOKING OVEN

(75) Inventors: Fabienne Reinhard-Herrscher, Kirchberg/Jagst (DE); Klaus Winkelmann, Gedem (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 427 days.

(21) Appl. No.: 12/989,248

(22) PCT Filed: May 12, 2009

(86) PCT No.: PCT/EP2009/003338

§ 371 (c)(1), (2), (4) Date: Oct. 22, 2010

(87) PCT Pub. No.: WO2009/141069

PCT Pub. Date: Nov. 26, 2009

(65) Prior Publication Data

US 2011/0049120 A1 Mar. 3, 2011

(30) Foreign Application Priority Data

May 17, 2008 (EP) ..... 08009169

(51) Int. Cl.
*F21V 33/00* (2006.01)
*F27D 21/02* (2006.01)

(52) U.S. Cl.
USPC ..... 362/92; 126/273 R; 362/234; 362/253; 362/294; 362/373

(58) Field of Classification Search
USPC ..... 362/92, 234, 253, 294, 373, 580; 126/273 R
See application file for complete search history.

(56) References Cited

U.S. PATENT DOCUMENTS

| | | | | |
|---|---|---|---|---|
| 2,240,144 | A * | 4/1941 | Mills | 362/92 |
| 7,874,690 | B2 * | 1/2011 | Weber et al. | 362/92 |
| 2005/0025993 | A1 | 2/2005 | Thompson et al. | |

FOREIGN PATENT DOCUMENTS

| | | |
|---|---|---|
| CH | 678913 | 11/1991 |
| DE | 3445923 | 8/1985 |
| DE | 102005044626 | 3/2007 |
| EP | 0922910 | 6/1999 |
| EP | 0976986 | 2/2000 |
| EP | 1598682 | 11/2005 |
| WO | 2007031503 | 3/2007 |

OTHER PUBLICATIONS

International Search Report for PCT/EP2009/003338, dated Sep. 28, 2009, 3 pages.

* cited by examiner

*Primary Examiner* — Stephen F Husar
(74) *Attorney, Agent, or Firm* — Pearne & Gordon LLP

(57) ABSTRACT

The present invention relates to a cooking oven with at least one cavity (12) and an illumination-equipment for said cavity (12). The cooking oven comprises a number of outer walls (14, 16, 18, 44) forming a casing (10) of the cooking oven, a number of inner walls (20, 22, 24, 40) enclosing the cavity (12), and a plurality of light emitting elements (30) arranged between the outer wall (14, 16) and the adjoining plane-parallel inner wall (20, 22), wherein the light emitting elements (30) are arranged in a distance from the inner wall (20, 22). At least one of the light emitting elements (30) is thermally connected to the casing (10) of the cooking oven, so that the light emitting element (30) is arranged within a heat sink of the cooking oven. The invention relates further to a corresponding illumination-equipment.

14 Claims, 3 Drawing Sheets

Figure 1:
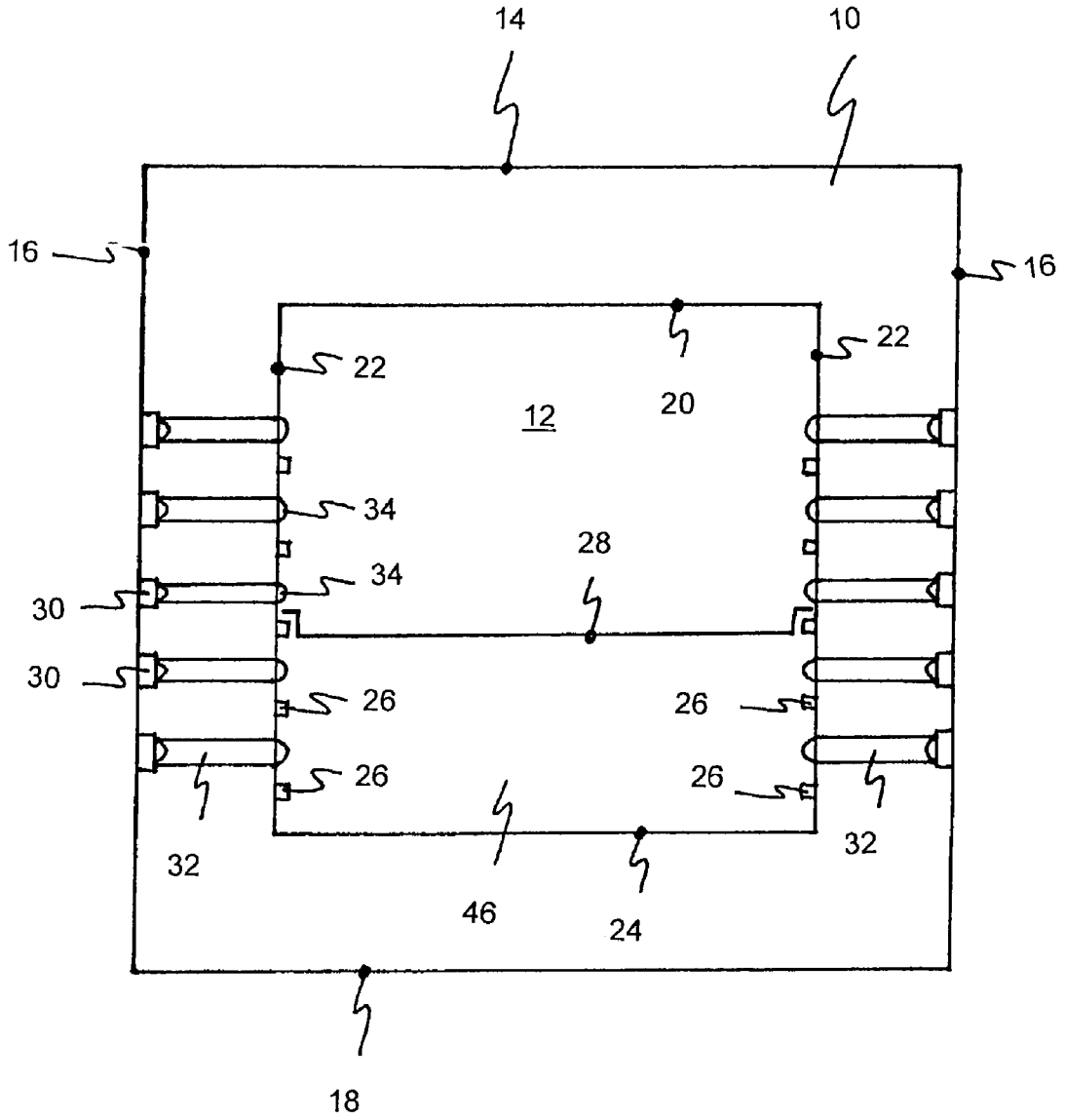

COOKING OVEN WITH AN ILLUMINATION-EQUIPMENT AND AN ILLUMINATION-EQUIPMENT FOR A CAVITY OF A COOKING OVEN

The present invention relates to a cooking oven according to the preamble of claim 1. Further, the present invention relates to an illumination-equipment according to the preamble of claim 14.

In a cooking oven during a cooking process a foodstuff is located in a cavity behind an oven door. Typically, the oven door includes a window, so that the user can observe the progression of the cooking process. For observing the cooking process the user must clearly see the foodstuff in the cavity, preferably from the outside of the cooking oven.

However, the illumination of the cavity in a typical cooking oven is not sufficient for monitoring the foodstuff. In a usual cooking oven the light source is arranged in a side wall or in a rear wall of the cavity. The light source in the side wall of the cavity produces shadows on the foodstuff. The light source in the rear wall of the cavity glares the user. In both cases the clear sight at the foodstuff is impaired. Thus, the user has to open the oven door in order to observe the foodstuff.

It would be advantageous to have a sufficient illumination within the cavity, so that the foodstuff can be observed from the outside of the cooking oven. Further, the light source should be arranged in an area with a relative low temperature in order to prevent the destruction of the light source.

Therefore, it is an object of the present invention to provide a cooking oven with an illumination-equipment, which allows a sufficient observation of the foodstuff from the outside of the cooking oven, wherein the light source is arranged in a cool environment preventing the destruction of the light source.

This object of the present invention is achieved by the cooking oven according to claim 1.

According to the present invention at least one of the light emitting elements is thermally connected to the casing of the cooking oven, so that the light emitting element is arranged within a heat sink of the cooking oven.

The main idea of the present invention is the arrangement of one or more light emitting elements in a distance from the cavity and in the heat sink of the cooking oven. The casing of the cooking oven acts as a heat sink. Thus, the temperature around the light emitting element is relative small. The heat sink between the inner and outer walls prevents the destruction of the light emitting elements. The plurality of light emitting elements can be arranged in such positions, that the foodstuff is optimal illuminated.

Preferably, the light emitting element is a light emitting diode (LED). The light emitting diode is able to provide the required spectrum of the light. Additionally, the light emitting diode needs small electric energy.

Further, the at least one of the light emitting elements is arranged at the inner side of at least one outer wall. On the one hand, these are especially cold positions within the cooking oven. On the other hand, the distance between the inner side of the outer wall and the cavity is relative small.

Alternatively or additionally, at least one of the light emitting elements is arranged within an air exhaust duct. Preferably, the air exhaust duct is arranged between the outer wall and the adjoining plane-parallel inner wall. For example, the air exhaust duct may be arranged between the outer top wall and the adjoining inner top wall. This is also a very efficient arrangement of the light emitting elements.

In a preferred embodiment of the present invention at least one of the light emitting elements corresponds with a light guide element. The light guide element allows a directed propagation of the light. Further, the light guide element has a low thermal conductivity. Thus, the light guide element supports the heat sink.

Especially, at least one of the light guide elements extends substantially straightforward between the corresponding light emitting element and a corresponding opening in the inner wall. The light guide element of this kind has a simple complexity.

Further, at least one lens may be arranged at a narrow side of at least one light guide element, and opposite to the corresponding light emitting elements. This allows the required light distribution. Further, a covering glass panel and/or the lens or the lens system is arranged within, behind and/or in front of the opening within the inner wall. The glass panel, the lens or the lens system may be provided to disperse the light beam from the light guide element. This allows the required illumination in the cavity. Alternatively, the lens may be realized by an adequate forming of the end portion of the light guide element.

Preferably the light guide element is formed as a rod and/or a tube. This is an efficient form of the light guide element. In general, the light guide element may have an arbitrary form.

In particular, the light guide element is made of glass or plastics. Both materials have a sufficient heat resistance.

At last, the light guide element may comprise a coating, so that the light beam is definitively guided within the light guide element by reflection or diffraction.

The object of the present invention is also achieved by the illumination-equipment according to claim 14.

According to the present invention at least one of the light emitting elements is provided to be thermally connected to the casing of the cooking oven, so that the light emitting element is arranged within a heat sink of the cooking oven.

The main idea of the illumination-equipment according to the present invention is the arrangement of the light emitting elements in a distance from the cavity and in the heat sink of the cooking oven. The casing of the cooking oven acts as a heat sink. Thus, the temperature around the light emitting element is relative small. The heat sink between the inner and outer walls prevents the destruction of the light emitting elements. The plurality of light emitting elements can be arranged in such positions, that the foodstuff is optimal illuminated.

In a preferred embodiment of the present invention the light emitting element is a light emitting diode (LED). The light emitting diode provides the required spectrum of the light with a sufficient brightness. Additionally, the light emitting diode needs small electric energy.

Further, at least one of the light emitting elements is provided to be arranged at the inner side of at least one outer wall. On the one hand, these are especially cold positions within the cooking oven. On the other hand, the distance between the inner side of the outer wall and the cavity will be relative small.

Alternatively or additionally, at least one of the light emitting elements is provided to be arranged within an air exhaust duct. Preferably, the light emitting elements provided for an air exhaust duct arranged between the outer wall and the adjoining plane-parallel inner wall. For example, the air exhaust duct may be arranged between the outer top wall and the adjoining inner top wall. This is also a very efficient arrangement of the light emitting elements.

In a preferred embodiment of the present invention at least one of the light emitting elements corresponds with a light guide element. The light guide element allows a directed propagation of the light. Further, the light guide element has a low thermal conductivity, so that the light guide element supports the heat sink.

In particular, at least one light guide element extends substantially straightforward between the corresponding light emitting element and a corresponding opening in the inner wall. This construction has a simple complexity.

In the preferred embodiment of the present invention at least one lens is arranged at a narrow side of at least one light guide element and opposite to the corresponding light emitting elements. This allows the required light distribution. Further, a covering glass panel, the lens or the lens system is provided to be arranged within, behind and/or in front of the opening within the inner wall. The glass panel, the lens or the lens system is able to disperse the light beam from the light guide element. This allows the required illumination in the cavity. Alternatively, the lens may be realized by an adequate forming of the end portion of the light guide element.

Preferably the light guide element may be formed as a rod and/or a tube. This is an efficient form of the light guide element. In general, the light guide element may have an arbitrary form.

In particular, the light guide element is made of glass or plastics. Both materials have a sufficient heat resistance.

At last, the light guide element may comprise a coating, so that the light beam is definitively guided within the light guide element by reflection or diffraction.

The novel and inventive features believed to be the characteristic of the present invention are set forth in the appended claims.

Figure 2:
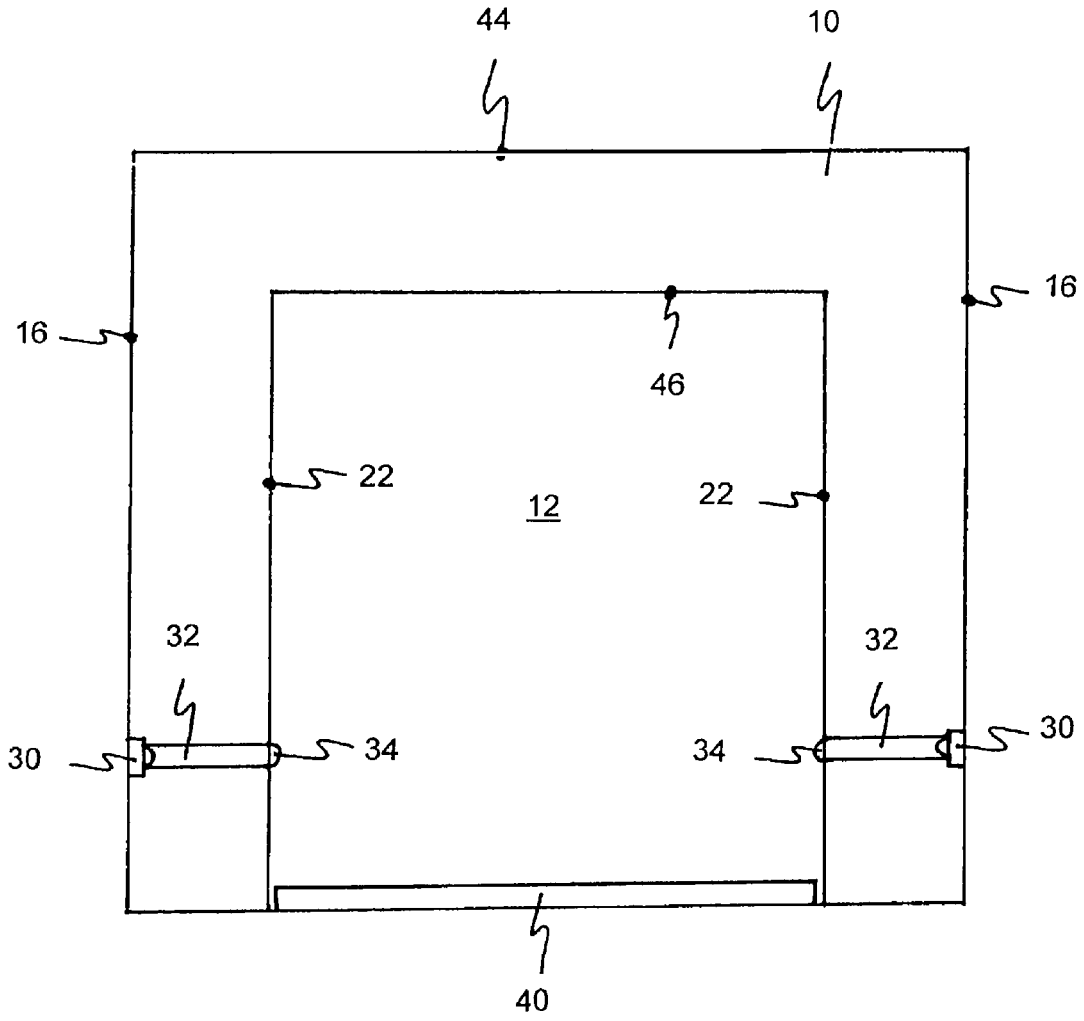
Figure 3:
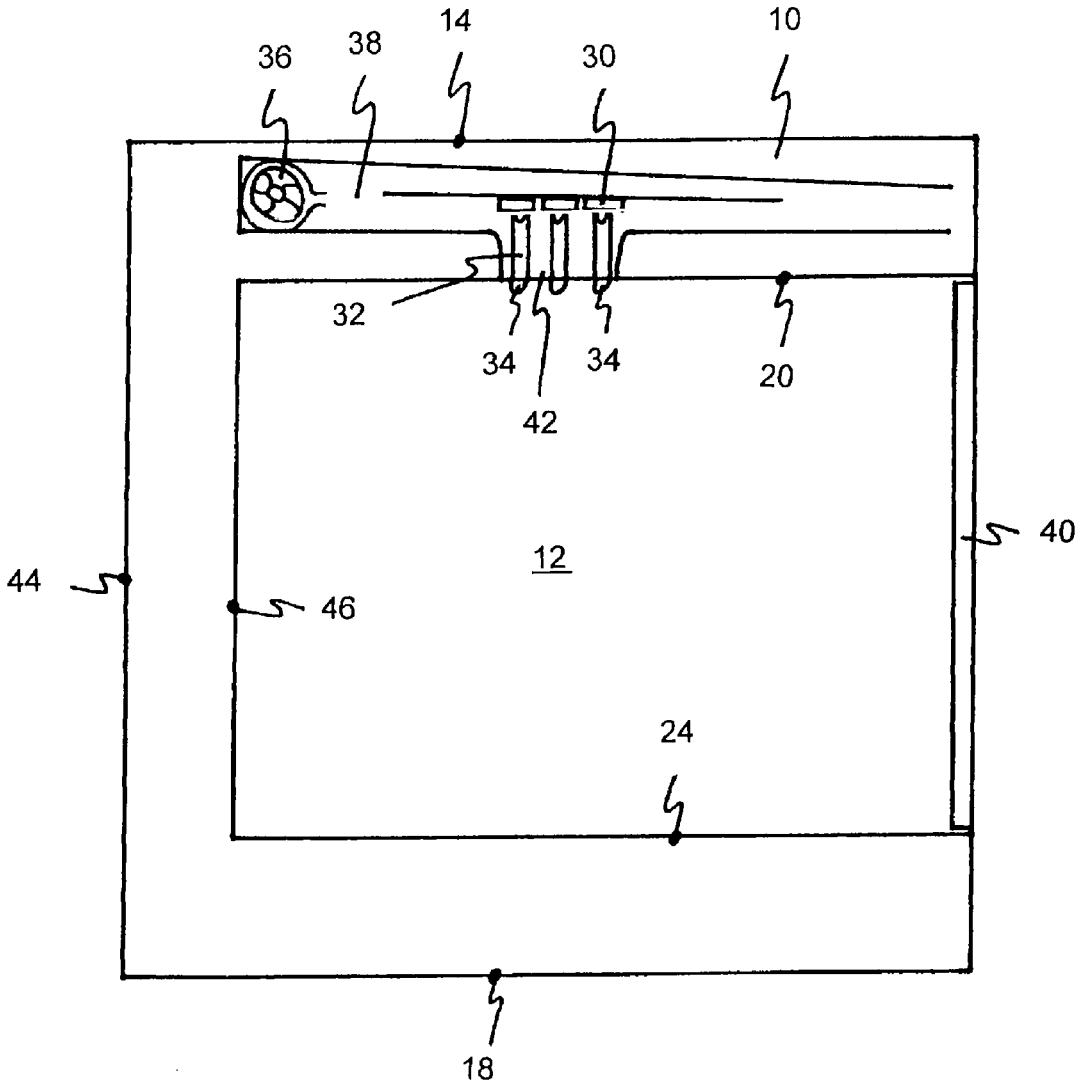

The invention will be described in further detail with reference to the drawing, in which FIG. 1 illustrates a schematic diagram of a sectional front view of a cooking oven according to a preferred embodiment of the present invention, FIG. 2 illustrates a schematic diagram of a sectional top view of the cooking oven according to the preferred embodiment of the present invention, and FIG. 3 illustrates a schematic diagram of a sectional side view of the cooking oven according to the preferred embodiment of the present invention.

FIG. 1 illustrates a schematic diagram of a sectional front view of a cooking oven according to a preferred embodiment of the present invention. The cooking oven comprises a casing 10 and a cavity 12. The casing is formed by an outer top wall 14, two outer side walls 16 and an outer bottom wall 18. The cavity 12 is formed by an inner top wall 20, two inner side walls 22 and an inner bottom wall 24.

A number of side grids 26 is arranged pair-wise on the inner sides of the inner side walls 22. Both side grids 26 of each pair are arranged at the same level. The side grids 26 extend horizontally along the inner sides of the inner side walls 22. The pair of side grids 26 is provided to support a tray 28 or a grid. This example comprises five pairs of side grids 26.

The outer walls 14, 16, 18 and the adjoining inner walls 20, 22, 24 are arranged plane-parallel, respectively. Between the inner side walls 22 and the adjoining outer side walls 22 a plurality of light emitting elements 30 are arranged. The light emitting elements 30 are arranged on the inner side of the outer side walls 16. The light beams from the light emitting elements 30 are substantially directed at the adjoining inner side walls 22. Preferably, the light emitting element 30 is realized by a light emitting diode (LED).

Each of the light emitting elements 30 corresponds with an elongated light guide element 32. The light guide element 32 extends from the corresponding light emitting element 30 to an opening in the inner side wall 22. The light guide element 32 extends substantially perpendicular to the plane of the inner side wall 22. The light guide element 32 may be a glass rod, which is preferably laminated or coated on its outside. Further, the light guide element 32 may be made of heat resistant plastics. In addition, the light guide element 32 may be a fibre optic light guide.

A lens 34 is arranged at the end of the light guide element 32. The lens 34 is arranged in front of the opening in the side wall 22 and at the inner side of the side wall 22. In this example the lens 34 extends marginally into the cavity 12.

The light beam is generated by the light emitting element 30 and guided by the light guide element 32. Then the light beam is dispersed by the lens 34 in order to create a light cone within the cavity 12. Said light cone covers substantially the inner side wall 22 on the opposite side and also an inner rear wall 46.

In this example there are five light emitting elements 30 at the outer side wall 16 on the left hand side as well as five light emitting elements 30 at the outer side wall 16 on the right hand side. Said five light emitting elements 30 and the corresponding light guide element 32 are arranged among each other. The light emitting elements 30 are arranged in a fore portion of the cavity 12, so that the light cone is directed to the inner rear wall 46 and the opposite inner side wall 22.

The arrangement of the light emitting elements 30 with the corresponding light guide elements 32 and lenses 34 allows a sufficient illumination of the foodstuff in the cavity 12. The light cone is directed to the inner rear wall 46 and to the opposite inner side wall 22, but not to the front side of the cavity. Thus, the user cannot be glared by the light cone.

The arrangement of the light emitting elements 30 at the inner side of the outer side walls 16 prevents a destruction of the light emitting elements 30, since the outer side walls 16 as well as the casing 10 are a heat sink. The light guide elements 32 are made of a material with a sufficient heat resistance. The straightforward form of the light guide elements 32 allows a production with low costs.

In an alternative embodiment, instead of the five light emitting elements 30 at each outer side wall 16 in FIG. 1, only two or three light emitting elements 30 can be arranged at each outer side wall 16. Said two or three light emitting elements 30 may be combined with additional one or more light emitting elements at the inner top wall 11 or the outer top wall 11.

FIG. 2 illustrates a schematic diagram of a sectional top view of the cooking oven according to the preferred embodiment of the present invention. FIG. 2 shows the outer side walls 16, the inner side walls 22, the outer bottom wall 18 and the inner bottom wall 24. The light emitting elements 30 and the light guide elements 32 on the left hand side as well as on the right hand side are arranged among each other. An oven door 40 is arranged at the front side of the cooking oven. The oven door 40 comprises a window.

FIG. 2 clarifies the positions of the light emitting elements 30 and the light guide elements 32 with reference to the front side and rear side of the cooking oven. The light emitting elements 30 and the light guide elements 32 are arranged near the oven door 40 of the cooking oven. These positions of the light emitting elements 30 and the light guide elements 32 allow an optimal illumination of the cavity 12 and prevent that the user is glared.

FIG. 3 illustrates a schematic diagram of a sectional side view of the cooking oven according to the preferred embodiment of the present invention. FIG. 3 shows the outer top wall 14, the inner top wall 20, the outer bottom wall 18, the inner bottom wall 24 and the oven door 40. Additionally, FIG. 3 shows an outer rear wall 44 and the inner rear wall 46.

Further, FIG. 3 shows a fan 36 and an air exhaust duct 38. The air exhaust duct 38 is arranged between the outer top wall 14 and the inner top wall 20. The air exhaust duct 38 extends from a rear portion to a front portion of the cooking oven. The fan 36 is arranged in a rear end of the air exhaust duct 38.

In the air exhaust duct 38 there are further light emitting elements 30 with corresponding light guide elements 32 and lenses 34. In this example three light emitting elements 30 and light guide elements 32 are arranged within the air exhaust duct 38. Other numbers of light emitting elements 30 and light guide elements 32 are also possible.

The light beams from the light emitting elements 30 are directed downwards through an opening 42 into the cavity 12. The opening 42 is formed as a window in the inner top wall 20. Other constellations are also possible.

The arrangement of the light emitting elements 30 and the light guide elements 32 within the air exhaust duct 38 prevent the destruction of the light emitting elements 30.

In an embodiment without the light guide elements 32 the light emitting elements 30 may be arranged in a housing, which is provided for one or more bulbs. For example, the light emitting elements 30 may be arranged behind a glass panel and/or in front of a reflector.

The cooking oven and the illumination-equipment according to the present invention allow an optimal illumination of the foodstuff in the cavity 12 on the one hand and prevent a destruction of the heat sensitive light emitting elements 30 on the other hand.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

List of Reference Numerals

10 casing
12 cavity
14 outer top wall
16 outer side wall
18 outer bottom wall
20 inner top wall
22 inner side wall
24 inner bottom wall
26 side grid
28 tray
30 light emitting element
32 light guide element
34 lens
36 fan
38 air exhaust duct
40 oven door
42 opening
44 outer rear wall
46 inner rear wall

The invention claimed is:

1. A cooking oven with at least one cavity (12) and an illumination-equipment for said cavity (12), wherein the cooking oven comprises: a number of outer walls (14, 16, 18, 44) forming a casing (10) of the cooking oven, a number of inner walls (20, 22, 24, 46) enclosing the cavity (12), a heat sink between the outer walls (14, 16, 18, 44) and the inner walls (20, 22, 24, 46), and a plurality of light emitting elements (30) arranged between one of the outer walls (14, 16) and one of the inner walls (20, 22), wherein the one of the inner walls (20, 22) adjoins and is plane-parallel to the one of the outer walls (14, 16), wherein the light emitting elements (30) are arranged in a distance from the inner wall (20, 22), characterized in, that at least one of the light emitting elements (30) is thermally connected to the casing (10) of the cooking oven, so that at least one of the light emitting elements (30) is arranged within the heat sink of the cooking oven.

2. The cooking oven according to claim 1, characterized in, that at least one of the light emitting elements (30) is a light emitting diode (LED).

3. The cooking oven according to claim 1, characterized in, that at least one of the light emitting elements (30) is arranged at the inner side of at least one of the outer walls (14, 16).

4. The cooking oven according to claim 1, characterized in, that at least one of the light emitting elements (30) is arranged within an air exhaust duct (38), wherein said air exhaust duct (38) is arranged between the outer wall (14) and the adjoining plane-parallel inner wall (20).

5. The cooking oven according to claim 4, characterized in, that the air exhaust duct (38) is arranged between an outer top wall of the casing and an adjoining inner top wall of the cavity.

6. The cooking oven according to claim 1, characterized in, that at least one of the light emitting elements (30) corresponds with a light guide element (32).

7. The cooking oven according to claim 6, characterized in, that the light guide element (32) extends substantially straightforward between the corresponding light emitting element (30) and a corresponding opening in the inner wall (20, 22).

8. The cooking oven according to claim 6 , characterized in, that at least one lens (34) is arranged at a narrow side of the light guide element (32) and opposite to the corresponding light emitting elements (30).

9. The cooking oven according to claim 8, characterized in, that the lens (34) or the lens system is arranged within, behind or in front of the opening within the inner wall (20, 22).

10. The cooking oven according to claim 8, characterized in, that the lens (34) or the lens system is provided to disperse the light beam from the light guide element (32).

11. The cooking oven according to claim 6, characterized in, that the light guide element (32) is formed as at least one of a rod and a tube.

12. The cooking oven according to claim 6, characterized in, that the light guide element (32) is made of glass or plastics.

13. The cooking oven according to claim 6, characterized in, that the light guide element (32) comprises a coating.

14. An illumination-equipment for a cooking oven with a casing (10) and at least one cavity (12), said casing (10) is formed by a number of outer walls (14, 16, 18, 44), said cavity (12) is enclosed by a number of inner walls (20, 22, 24, 46) and the illumination-equipment comprises a plurality of light emitting elements (30) provided to be arranged between one of the outer walls (14, 16) and one of the inner walls (20, 22), wherein the one of the inner walls (20, 22) adjoins and is plane-parallel to the one of the outer walls (14, 16), wherein a heat sink is located between the outer walls (14, 16, 18, 44) and the inner walls (20, 22, 24, 46), wherein the light emitting elements (30) are provided to be arranged in a distance from the inner wall (20, 22), characterized in, that at least one of the light emitting elements (30) is provided to be thermally connected to the casing (10) of the cooking oven, so that the light emitting element (30) is arranged within the heat sink of the cooking oven.

* * * * *